United States Patent [19]

Gajewski

[11] Patent Number: 5,033,129

[45] Date of Patent: Jul. 23, 1991

[54] FLOW AUGMENTED TOILET FLUSHING UNIT

[76] Inventor: Jan Gajewski, 3501 East Gold Dust, Phoenix, Ariz. 85028

[21] Appl. No.: 535,395

[22] Filed: Jun. 8, 1990

Related U.S. Application Data

[63] Continuation-in-part of Ser. No. 323,670, Apr. 7, 1989, abandoned.

[51] Int. Cl.[5] ..... E03D 1/14

[52] U.S. Cl. ..... 4/326

[58] Field of Search ..... 4/324–327

[56] References Cited

U.S. PATENT DOCUMENTS

| | | | |
|---|---|---|---|
| 1,960,864 | 5/1934 | Brown | 4/326 |
| 2,237,294 | 4/1941 | Easley | 4/326 |
| 2,505,091 | 4/1950 | Brebis | 4/326 |
| 2,731,647 | 1/1956 | Groth et al. | 4/326 |
| 2,864,095 | 12/1958 | Martino | 4/37 |
| 3,173,152 | 3/1965 | McCrink | 4/325 X |
| 3,237,211 | 5/1966 | Brown | 4/326 |
| 3,795,016 | 3/1974 | Eastman | 4/326 |
| 3,909,856 | 10/1975 | Dunn, Jr. | 4/326 |
| 3,913,149 | 10/1975 | Brinton | 4/326 |
| 3,918,105 | 11/1975 | Young | 4/326 |
| 4,003,097 | 1/1977 | Book | 4/326 |
| 4,042,982 | 8/1977 | Contreras | 4/326 |
| 4,122,564 | 10/1968 | Addicks | 4/326 |
| 4,406,024 | 9/1983 | Chiu et al. | 4/324 |

*Primary Examiner*—Charles E. Phillips

*Attorney, Agent, or Firm*—Cahill, Sutton & Thomas

[57] ABSTRACT

A dual level toilet flushing unit includes two different height conduits in fluid communication with one another at a junction close to the discharge opening of the unit to permit selection of the quantity of water to be flushed. A rounded elbow smoothly diverts the water flowing from the taller conduit and having a lesser head pressure toward the junction. A curved baffle within a horizontal section of the taller conduit directs the water from the elbow to one side of the discharge opening and circularly along an expanded annular shroud upstream of the discharge opening to impart a swirling action to the water and increase the force of the water entering the discharge opening. A manually actuated linkage selects the conduit through which the water is to flow.

8 Claims, 2 Drawing Sheets

FLOW AUGMENTED TOILET FLUSHING UNIT

CROSS REFERENCE TO RELATED APPLICATIONS

The present application is a continuation-in-part and an improvement over a pending application entitled "DUAL LEVEL TOILET FLUSHING UNIT", Ser. No. 323,670, filed on Apr. 7, 1989, now abandoned, and describing an invention of which the present inventor is a coinventor.

BACKGROUND OF THE INVENTION

1. Field of the Invention

The invention relates to toilet flushing systems which conserve water by providing different amounts of water flushing potential depending upon the type of waste to be removed from the toilet.

2. Description of the Prior Art

Toilet flushing systems consume a large amount of water every day. Most such systems use the same volume of water regardless of the type of waste to be removed from the toilet, resulting in needless water consumption.

U.S. Pat. No. 4,406,024 discloses a flushing actuator which opens a single flush valve for varying lengths of time, releasing different amounts of water to the toilet depending on the waste removal requirement. However, the different flushing levels are coupled in a manner which can often result in selection of the incorrect flushing level. For example, flush volume is selected by depressing the handle of the controller for a short time for a small volume or a long time for a large volume. Since the user must guess the approximate length of time to depress the handle, either too much or not enough flush water is often used for a given waste removal requirement.

Dual valve flushing systems are disclosed in U.S. Pat. Nos. 2,864,095, 3,913,149, 3,909,856, 4,042,982 and 4,122,564. Although these dual level flushing systems may avoid the problems associated with the above described device, they require special parts rather than standard plumbing items. In addition, absent other modifications to the prior art toilet flushing systems, the lesser head pressure associated with a smaller flush volume may not adequately remove even lesser quantities or less solid types of waste.

For example, the dual level systems include two different height conduits which discharge water to the toilet. The tall conduit is usually about twice the height of the short conduit; consequently, the tall conduit, having only about half the water head pressure or flushing force of the short conduit can convey only half as much water to the toilet. The available flushing force of water in the tall conduit is diminished by the flow discontinuities induced by a sharp bend in the conduit from vertical to nearly horizontal near the discharge point of the toilet in combination with the further force dissipating change in the direction at the discharge outlet.

SUMMARY OF THE INVENTION

A dual level toilet flushing unit is connected to the discharge opening of a flush tank. A first water conduit has an open upper end aligned directly above and connected to the discharge opening. Above the discharge opening is a second water conduit extending horizontally from the side of the first water conduit and bending to an orientation substantially straight upward in a rounded elbow shape conducive to minimizing velocity decrease in the downflowing water. The discharge opening is surrounded by a diametrically enlarged partial cylindrical shroud to assist in creating a swirling, turbulent motion in water moving at high velocity from the rounded elbow. To augment the swirling action, a curved baffle in the horizontal extension directs the water to one side of the cylindrical shroud. The second water conduit has an open upper end at a higher level than the open upper end of the first water conduit, with the result that a greater amount of water from the flush tank will flow into the first water conduit than into the second water conduit.

First and second valve members are seated on the upper ends of the first and second water conduits, respectively, to selectively open and close the conduits. To operate the valve members, valve lifting means are connected to the first and second valve members and also to a handle positioned on the outside of the flush tank.

Accordingly, it is a primary object of the present invention to provide two different height conduits for a toilet flushing unit, either of which provides a sufficient force of flush water, to flush the toilet.

Another object of the present invention is to provide a dual level toilet flushing unit which is simple to install in existing toilet systems.

Yet another object of the present invention is to provide a dual level toilet flushing unit which can reliably select either of the two levels.

Still another object of the present invention is to provide a dual level toilet flushing unit which will satisfactorily remove waste from toilets at both a high water flushing potential and a low water flushing potential.

A further object of the present invention is to amplify the available flushing force of the water under low head pressure conditions.

A still further object of the present invention is to provide a baffle for urging cyclonic flow of flush water into the discharge opening of a flush toilet.

A yet further object of the present invention is to provide a method for flushing a toilet with one of two selectable quantities of flush water without impeding the flush capability of the toilet.

These and other objects of the present invention will become apparent to those skilled in the art as the description thereof proceeds.

BRIEF DESCRIPTION OF THE DRAWINGS

The present invention will be described with greater clarity and specificity with reference to the following drawings, in which.

DESCRIPTION OF THE PREFERRED EMBODIMENT

Figure 1:
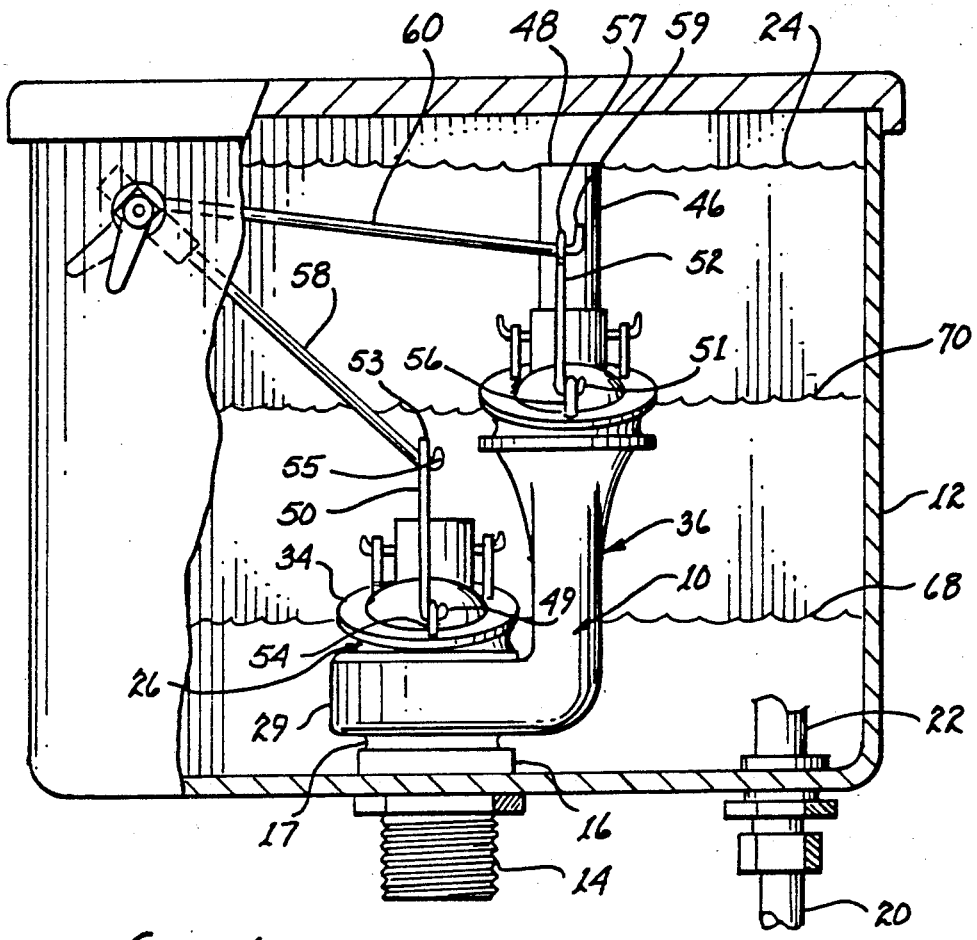
FIG. 1 is a representation of a dual level toilet flushing unit incorporating the present invention.
Figure 2:
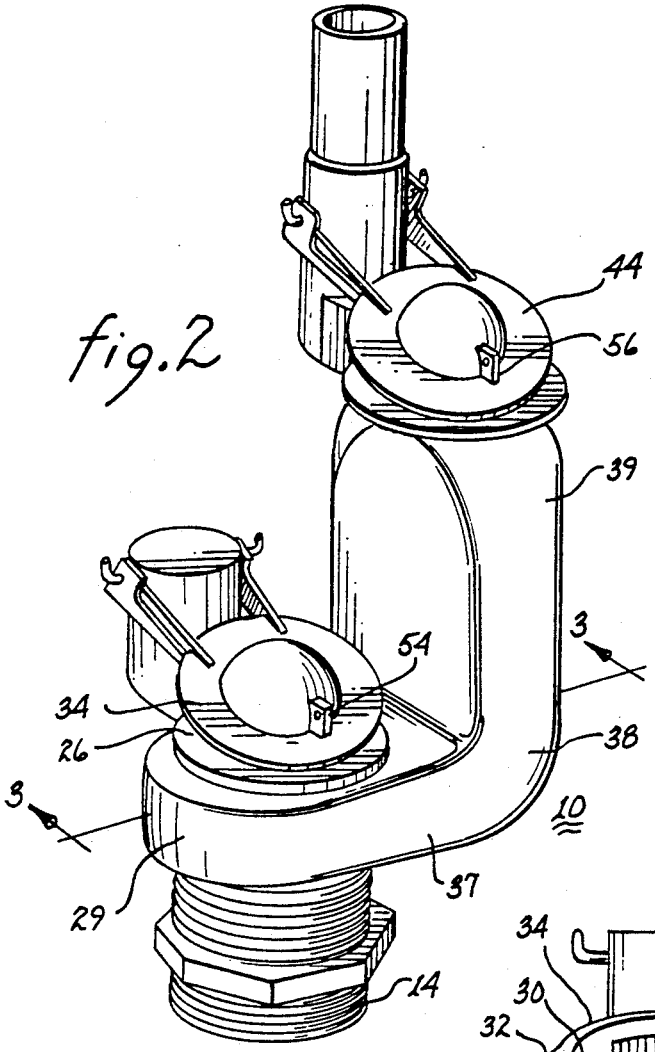
FIG. 2 is a representation of the dual level water conduits and valve members incorporated in the present invention.
Figure 3:
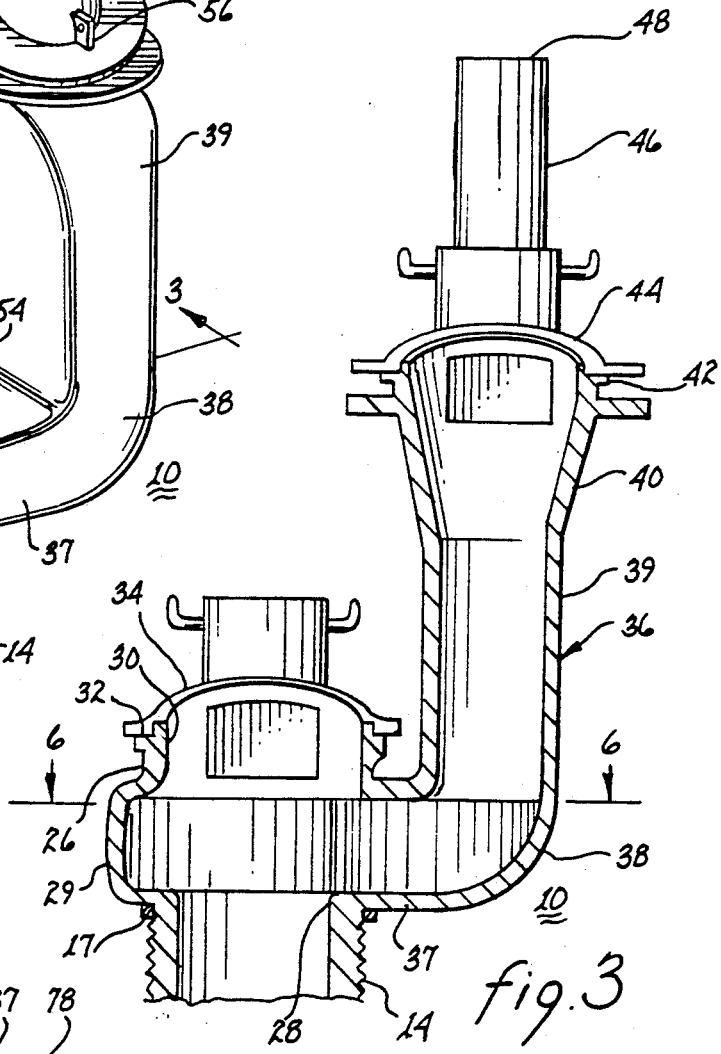
FIG. 3 is a sectional view taken along lines 3—3, as shown in FIG. 2.

Referring to FIGS. 1, 2 and 3, a dual level toilet flushing unit 10 is secured within a toilet tank 12 mounted over a toilet bowl and a discharge pipe 14 projects through an opening in the toilet bowl. Gasket 16 fits around pipe 14 and against the lower side of a shoulder 17 to form a seal. Water is supplied to a toilet tank 12 through water line 20 and input line 22 controlled by a float (not shown). Normally, the water level will be as close to the top of toilet tank 12 as possible, for example, level 24 shown in FIG. 1.

Dual level toilet flushing unit 10 includes a first water conduit 26 aligned directly above and connected to discharge opening 28. An annularly expanded semi cylindrical surface or shroud 29 is disposed above discharge opening 28. First water conduit 26 has an open upper end 30 surrounded by a first valve seat 32 and pivotally connected to a first valve member 34 for selectively opening and closing the open end of first water conduit.

Joined to one side of first water conduit 26 above discharge opening 28 is a second water conduit 36. It includes a horizontal extension 37 extending horizontally from the side of the first water conduit and it is an extension of shroud 29. A rounded elbow 38 bends conduit 36 substantially straight upward to interconnect with vertical extension 39. Second water conduit 36 has an open upper end 40 at a higher level than open upper end 30 of first water conduit 26, with the result that a lesser volume of water from flush tank 12 will flow into the second water conduit than into the first water conduit. Surrounding open upper end 40 of second water conduit 36 is a second valve seat 42 having a pivotally connected second valve member 44 for selectively opening and closing the open end of the second water conduit. Preferably, the first and second valve seats and valve members are standard units, such as rubber ball valves.

Attached in open connection to second valve seat 42 is overflow pipe 46 extending vertically upward to open end 48 near the top of flush tank 12, approximately corresponding to high water level 24 of the flush tank. Overflow pipe 46 receives excess water in the event that flush tank 12 overfills.

Figure 4:
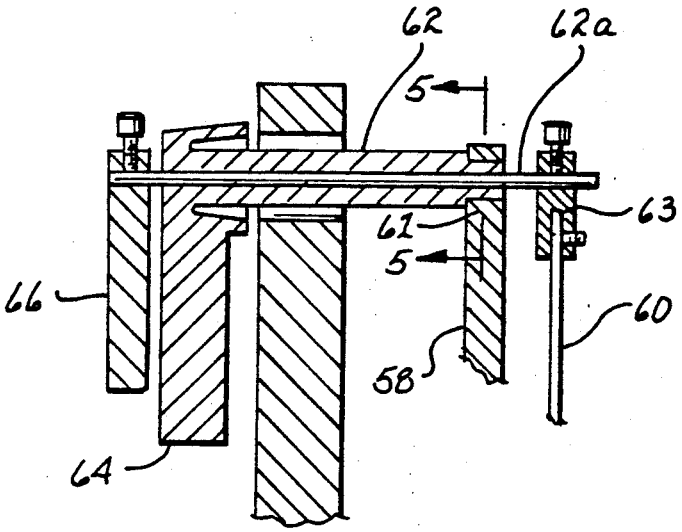
FIG. 4 is a sectional view of the toilet tank mounted handle.
Figure 5:
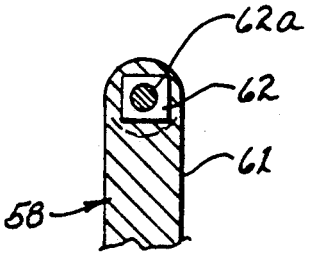
FIG. 5 is a sectional view taken along lines 5—5, as shown in FIG. 4.

For ease in manipulation, first and second valve members 34 and 44 contain first and second hook eyes 54 and 56 hooked to end 49 of first stem 50 and end 51 of second stem 52, respectively. Other end 53 of first stem 50 attaches to end 55 of first link arm 58; in similar manner, the other end 57 of second stem 52 attaches to end 59 of second link arm 60. As shown more clearly in FIGS. 4 and 5, the first and second link arms 58 and 60 are attached at their opposite ends 61 and 63, respectively, to coaxial shafts 62 and 62A positioned on the inside of flush tank 12 and protruding through the flush tank to the outside. The outside ends of shafts 62 and 62A are attached to first handle 64 and second handle 66, respectively, located on the outside of flush tank 12.

When first handle 64 is moved to its operative position, shaft 62 pulls first link arm 58 to lift up first stem 50 and open first valve member 34. When first valve member 34 is open, approximately the entire flush tank of water will flush down first water conduit 26, through the discharge opening 28 and into the toilet bowl to remove wastes therefrom. The level in toilet tank 12 will drop from full level 24 to nearly empty level 68, which will prompt the float control attached to input line 22 to refill toilet tank 12 to its original level. The complete flushing potential accomplished by use of first water conduit 26 will normally be used to remove primarily solid waste from the toilet bowl.

If a different or less solid type of waste is to be removed from the toilet bowl, second handle 66 is used. When second handle 66 is moved to its operative position, shaft 62A pulls second link arm 60 to lift up second stem 52 and open second valve member 44. When second valve member 44 is open, approximately half the toilet tank of water flushes down the second water conduit 36, through the discharge opening 28 and into the toilet for waste removal. Choosing the lower flushing potential associated with second water conduit 36 lowers the water level from level 24 to half level 70, thereby conserving approximately half a tank of water above that which would be used in a normal toilet having only one level of flushing potential. When half level 70 is reached, the float control attached to input line 22 will cause toilet tank 12 to refill to level 24.

Instead of using two separate handles, one handle can be used by incorporating therein two different operating positions corresponding to selective opening or closing of the two valve members 34 and 44. For example, one handle can be connected to first and second shafts which are further connected, respectively, in first and second means for opening the first and second valve members 34 and 44. When the handle is moved to a first operating position, the first shaft will open the first valve member and approximately the entire flush tank of water will flush down first water conduit 26, through discharge opening 28 and into the toilet bowl. When the handle is moved to a second operating position, the second shaft will open the second valve member and approximately half the flush tank of water will flush down second water conduit 36, through discharge opening 28 and into the toilet.

Figure 6:
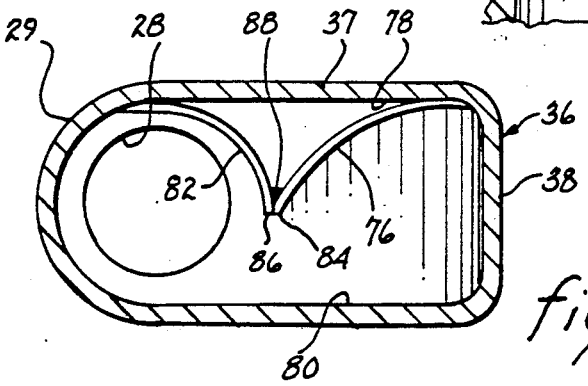
FIG. 6 is a sectional view taken along lines 6—6, as shown in FIG. 3.

To urge maximum water force of the water flowing into discharge pipe 14 from the second water conduit which has less head pressure, a cyclonic or swirling action is imparted to the flowing water beginning at elbow 38. As particularly shown in FIGS. 3 and 6, a baffle 76 extends from the interior of sidewall 78 of water conduit 36 proximate elbow 38 and smoothly curves inwardly to the approximate mid width of horizontal extension 37. With this baffle, the flushing water flowing down vertical extension 39 will be channeled toward interior sidewall 80 of horizontal extension 37 and toward one end of shroud 29 adjacent discharge opening 28. Such channeling will tend to cause the discharging flush water to have a cyclonic or swirling motion upon entry into discharge opening 28. To augment the cyclonic flow, a further baffle 82 extends from the other end of shroud 29 and curves to join edge 84 of baffle 76. Edges 84,86 of the two baffles may be adhesively or otherwise secured to one another, as represented by mastic 88. The curvature of baffle 82, which may be concentric with discharge opening 28, augments and enhances the cyclonic flow of the discharge water from conduit 36. It is understood that apertures or other flow accommodating spaces may be incorporated in the baffles to permit water drainage from the space intermediate sidewall 78 and baffles 76,82. Rather than have one or both baffles 76,82 extend vertically for the full height of horizontal extension 37, each or either may be of a lesser height to guide, rather than force, the direction of water flow.

The swirling turbulent motion developed in discharge opening 28 creates a greater flushing ability than is normally present with the lower volume level common to dual level toilet systems. Thereby, a greater range of wastes can satisfactorily be removed from the toilet bowl while using a lesser volume of water than is customary.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. A dual level flushing unit selectively discharges either a full or less than full quantity of water from the water tank of a flush toilet into the discharge opening of the water tank and into the toilet bowl, said unit comprising in combination:

a) a first conduit in fluid communication with the discharge opening and extending upwardly therefrom for discharging the full quantity of water;

b) a second conduit in fluid communication with the discharge opening and extending upwardly therefrom to a greater extent than said first conduit for discharging less than the full quantity of water;

c) a junction for interconnecting said first and second conduits at a location above the discharge opening;

d) said junction including an annularly expanded shroud disposed about a part of said first conduit for imposing a swirling action on the water flowing through said second conduit and into said junction to maximize the force of the water entering the discharge opening from said second conduit and to increase the flushing capability of the water discharged through said second conduit;

e) baffle means for urging water flow from said second conduit in a circular path and along at least a part of said shroud to augment the swirling action of the water;

f) valve means for selectively controlling water flow into said first and second conduits from the water tank; and g) means for selectively actuating said valve means.

2. The dual level toilet flushing unit as set forth in claim 1 including further baffle means for discouraging water flow from said shroud and into said second conduit.

3. A dual level toilet flushing unit for diverting water to the discharge opening of a flush tank and into a toilet bowl to remove wastes from the toilet bowl, said unit comprising in combination:

a) a first water conduit for discharging water, said first water conduit being aligned directly above and connected to the discharge opening of the flush tank, said first water conduit including an open upper end;

b) a second water conduit for discharging water, said second water conduit being joined to one side of said first water conduit above the discharge opening and extending horizontally from the side of said first water conduit to define a horizontal extension and bending substantially straight upward in a rounded elbow, a baffle disposed within said horizontal extension for urging water flow toward one side of the discharge opening and encouraging cyclonic flow and swirling of the water into the discharge opening, said second water conduit having an open upper end at a higher level than the open upper end of said first water conduit, whereby a lesser amount of water from the flush tank will flow into said second water conduit than into said first water conduit;

c) a shroud defining an annularly expanded volume upstream of the discharge opening and in general alignment with said horizontal extension for receiving water flow directed by said baffle and for further encouraging cyclonic flow and swirling of the water into the discharge opening to increase the flushing ability of the water from said second conduit to remove wastes from the toilet;

d) a first valve member seated on the upper end of said first water conduit for selective opening and closing of the open end of said first water conduit;

e) a second valve member seated on the upper end of said second water conduit for selective opening and closing of the open end of said second water conduit; and f) means for selectively opening said first and second valve members.

4. The dual level toilet flushing unit as set forth in claim 3, wherein said baffle extends from one side of said horizontal extension to a location interior of said horizontal exterior.

5. The dual level toilet flushing unit as set forth in claim 3, including a further baffle partially encircling the discharge opening for discouraging water flow from within said shroud into said horizontal exterior.

6. A dual level toilet flushing unit for diverting water to the discharge opening of a flush tank and into a toilet bowl to remove wastes from the toilet bowl, said unit comprising in combination:

a) a first water conduit for discharging water, said first water conduit being aligned directly above and connected to the discharge opening of the flush tank, said first water conduit including an open upper end;

b) a first valve seat surrounding the open upper end of said first water conduit;

c) a first valve member pivotally connected to said first valve seat for selectively opening and closing the open end of said first water conduit;

d) a second water conduit for discharging water, said second water conduit being joined to one side of said first water conduit above the discharge opening, said second conduit including a horizontal extension extending horizontally from the side of said first water conduit, an elbow disposed at the end of said horizontal extension for bending the flow through said second water conduit 90° and a vertical extension extending from said elbow, said vertical extension of said second water conduit having an open upper end at a higher level than the open upper end of said first water conduit, whereby a lesser amount of water from the flush tank will flow into said second water conduit than into said first water conduit;

e) a second valve seat surrounding the open upper end of said second water conduit;

f) a second valve member pivotally connected to said second valve seat for selective opening and closing of the open upper end of said second water conduit;

g) a baffle disposed within said horizontal extension for urging water flow to one side of the discharge opening;

h) an expanded annular shroud adjacent the discharge opening in fluid communication with said horizontal extension for receiving water diverted by said baffle and for creating a swirling, turbulent motion in the water moving at high velocity from said second water conduit: to the discharge opening to increase the flushing ability of the water from said second conduit and remove wastes from the toilet; and i) means for selectively actuating said first and second valve members.

7. The dual level toilet flushing unit as set forth in claim 6 including a further baffle disposed at least partly within said annular shroud for encouraging water flow concentric with the discharge opening.

8. The dual level toilet flushing unit as set forth in claim 7 wherein said further baffle extends into said horizontal extension to discourage water flow into said horizontal extension from said annular shroud.

* * * * *